US010968918B2

(12) United States Patent
Watson et al.

(10) Patent No.: US 10,968,918 B2
(45) Date of Patent: Apr. 6, 2021

(54) WEAR RINGS FOR ELECTRIC SUBMERSIBLE PUMP STAGES

(71) Applicant: Schlumberger Technology Corporation, Sugar Land, TX (US)

(72) Inventors: Arthur I. Watson, Sugar Land, TX (US); David Milton Eslinger, Collinsville, OK (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 601 days.

(21) Appl. No.: 14/917,555

(22) PCT Filed: Sep. 10, 2014

(86) PCT No.: PCT/US2014/054951
§ 371 (c)(1),
(2) Date: Mar. 8, 2016

(87) PCT Pub. No.: WO2015/038616
PCT Pub. Date: Mar. 19, 2015

(65) Prior Publication Data

US 2016/0222976 A1 Aug. 4, 2016

Related U.S. Application Data

(60) Provisional application No. 61/876,025, filed on Sep. 10, 2013.

(51) Int. Cl.
*F04D 29/08* (2006.01)
*F04D 1/06* (2006.01)
(Continued)

(52) U.S. Cl.
CPC ..... *F04D 29/086* (2013.01); *F04D 1/00* (2013.01); *F04D 1/06* (2013.01); *F04D 13/08* (2013.01)

(58) Field of Classification Search
CPC . F04D 29/086; F04D 1/00; F04D 1/06; F04D 13/08
See application file for complete search history.

(56) References Cited

U.S. PATENT DOCUMENTS 2,785,913 A * 3/1957 Solari ..... F16J 15/36 277/391
3,975,113 A * 8/1976 Ogles ..... F04D 1/00 415/180
(Continued)

FOREIGN PATENT DOCUMENTS

JP 2007517162 A 6/2007

OTHER PUBLICATIONS

Chemical Processing, "Pump Repair and Restoration Guidelines", Dec. 18, 2005, [http://www.chemicalprocessing.com/industrynews/2005/092.html], Retrieved Jan. 29, 2018, 8 pages.
(Continued)

*Primary Examiner* — Kenneth Bomberg
*Assistant Examiner* — Adam W Brown

(57) ABSTRACT

Wear rings for electric submersible pump (ESP) stages are provided. An example ESP has one or more running clearance seals reinforced with high-hardness wear rings. Ceramics and carbides may provide the high hardness for the wear rings, but such substances are more brittle than metals and have different coefficients of thermal expansion than metals. For protection, each high-hardness wear ring may be mounted with an elastic cushioning scheme. The elastic mounting preserves each wear ring from shock, stress, and breakage from thermal expansion and contraction of an adjacent pump part. Each high-hardness wear ring may also have a low-stress driving mechanism that cushions the rotational force imparted to the wear ring when the ESP pump is being powered. In some implementations, the
(Continued)

elastic mounting scheme may also serve as the low-stress driving mechanism for the high-hardness wear ring.

18 Claims, 10 Drawing Sheets

(51) Int. Cl.
*F04D 1/00* (2006.01)
*F04D 13/08* (2006.01)

(56) References Cited

U.S. PATENT DOCUMENTS 4,664,595 A * 5/1987 Tsuji ..... F04D 13/10 384/222
4,768,923 A * 9/1988 Baker ..... F04D 29/628 277/371
4,779,876 A * 10/1988 Novosad ..... F16J 15/348 277/375
4,913,619 A * 4/1990 Haentjens ..... F04D 29/167 415/172.1
5,133,639 A * 7/1992 Gay ..... F04D 1/063 277/365
5,209,577 A * 5/1993 Swatek ..... E21B 4/003 384/220
7,988,411 B2 * 8/2011 Lienau ..... F16J 15/445 415/174.4
2006/0024174 A1 * 2/2006 Welch ..... F04D 1/063 417/360
2006/0198731 A1 9/2006 Shaw et al.
2007/0280823 A1 12/2007 Kanemori
2009/0285678 A1 * 11/2009 Brunner ..... F04D 29/44 415/199.3
2010/0166578 A1 * 7/2010 Watson ..... F04D 13/10 417/423.3
2012/0156012 A1 6/2012 Ure Villoria

OTHER PUBLICATIONS

Engineers Edge, "Centrifugal Pumps Wearing Ring Review", [http://www.engineersedge.com/pumps/wearing_rings.htm], retrieved Jan. 29, 2018, 2 pages.

* cited by examiner

WEAR RINGS FOR ELECTRIC SUBMERSIBLE PUMP STAGES

RELATED APPLICATIONS

This patent application claims the benefit of priority to U.S. Provisional Patent Application No. 61/876,025 to Watson et al., filed Sep. 10, 2013, and incorporated by reference herein in its entirety.

BACKGROUND

Artificial lift operations using electric submersible pumps (ESPs) to recover hydrocarbons often utilize multistage centrifugal pumps. Each pump stage includes a spinning impeller and a stationary diffuser, most often made of metal. To limit leakage recirculation within a stage, a running seal between the impeller and the diffuser is incorporated into the design, by providing a close clearance between certain proximate features of these components. A running seal may be created by closely mating the outside-diameter surfaces of spinning impeller skirts to the stationary inside diameter bores of diffuser skirts, at both ends of the impeller, to form the running seals. Other similar features may also be closely mated instead, to form a running seal. Over time, these closely mated features are subject to abrasive wear, especially due to sand and other abrasive particles that occur in the well fluids being pumped. The abrasive wear leads to losses of head, flow, and efficiency due to increased leakage recirculation from the impeller back through the running seal to the suction input of the pump stage.

Conventionally, metal wear rings can be used to repair or replace the running seal faces in worn ESP stages. However, wear rings that are even harder than conventional metal wear rings have not been used to refurbish the running seals in ESPs, because the extreme conditions inside the ESP damage such unconventional wear rings. High-hardness wear rings have not been used to strengthen the running seals of ESPs because it is difficult to protect them within the harsh ESP environment.

SUMMARY

An electric submersible pump provides wear resistance by including an impeller, a diffuser, and a high-hardness wear ring associated with a running clearance seal between the impeller and the diffuser, and possessing a hardness greater than the hardness of metals. In an implementation, an electric submersible pump has an impeller, diffuser, the high-hardness wear ring associated with a running clearance seal between the impeller and the diffuser, and one or both of an elastic mounting system for preventing stress or breakage of the high-hardness wear ring, and a low-stress drive system for powering the electric submersible pump while preventing stress or breakage to the high-hardness wear ring. An example method includes incorporating a high-hardness wear ring into a running clearance seal of an electric submersible pump, and providing an elastic mounting for the high-hardness wear ring to protect it from stress and breakage. This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein.

DETAILED DESCRIPTION

Overview

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

Figure 1:
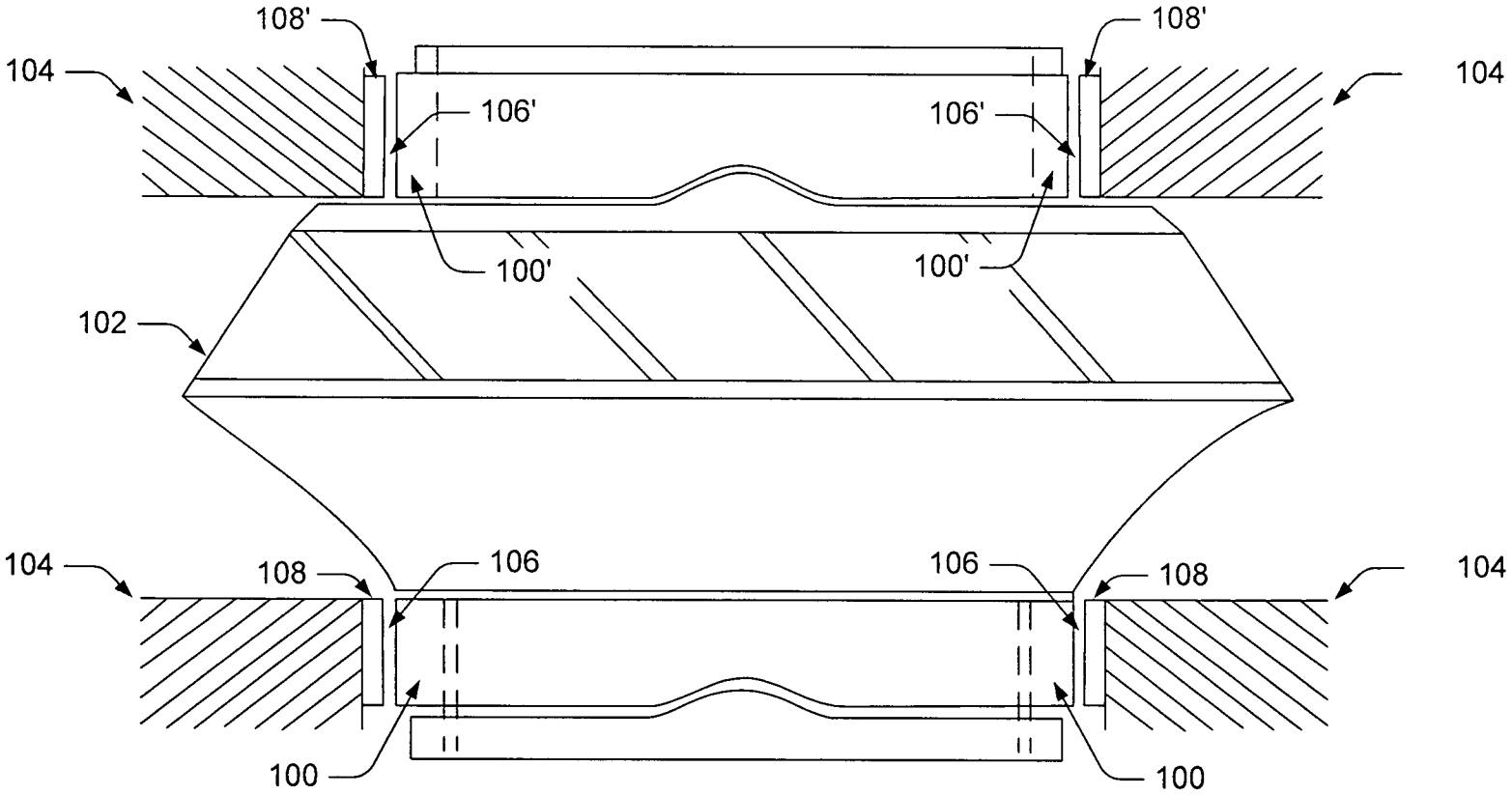
FIG. 1 is a diagram of an example ESP pump stage using high-hardness wear rings.

This disclosure describes example embodiments of wear rings for electric submersible pumps (ESPs). As shown in FIG. 1, a wear ring 100 is a circular surface implemented in an ESP pump stage, for example on the impeller 102, to resist abrasive friction. The wear ring 100 may be part of a disk, ring, or cylinder disposed either vertically or horizontally in the ESP stage where needed. Each pump stage may include a spinning impeller 102 and a stationary diffuser 104, most often made of metal. To limit leakage recirculation within the ESP stage, a running seal 106 between a part of the impeller 102 and a part of the diffuser 104 is incorporated into the design, by providing a close clearance between certain proximate features of these components (gap of running seal 106 not shown to scale in FIG. 1). Wear rings 100 can be used to line one or both sides of such a running seal 106. For example, the other side of the running seal 106 may be made up of another corresponding mated wear ring 108 fastened to the stationary diffuser 104. A given ESP stage may have additional sets of wear rings 100' & 108' for other running seals 106' between the impeller 102 and the diffuser 104.

An example ESP has one or more running clearance seals 106 reinforced with the high-hardness wear rings 100. Ceramics and carbides may provide the high hardness for the wear rings 100, but such substances are more brittle than metals and have different coefficients of thermal expansion than metals. For protection, each high-hardness wear ring 100 may be mounted with an elastic cushioning scheme. The elastic mounting preserves each wear ring 100 from shock, stress, and breakage from thermal expansion and contraction of an adjacent pump part. Each high-hardness wear ring 100 may also have a low-stress driving mechanism that cushions the rotational force imparted to the wear ring 100 when the ESP pump is being powered. In some implementations, the elastic mounting scheme may also serve as the low-stress driving mechanism for the high-hardness wear ring 100.

Example Systems

Example pump stage configurations described herein adapt high-hardness (or "hardened") wear rings, for example wear rings 100 & 108, to the running seals and other wear areas of an ESP pump stage. The high-hardness wear rings 100 are either placed during manufacture to prevent and retard wear from the outset in an ESP pump stage, or placed later to restore the performance of a pump stage after it has already worn by fitting high-hardness wear rings 100 to an ESP pump stage not originally equipped with them, or by replacing existing wear rings 100 that have become worn with even harder wear rings 100.

High-hardness wear rings 100 can be brittle and vulnerable to some types of breakage despite their hardness and resistance to wear in their appointed function. This disclosure describes how to mount and how to rotationally drive the high-hardness wear rings 100 in the harsh environment of an ESP, in ways that protect the wear rings 100 from mechanical stress and from damage due to differences in thermal expansion.

In the case of thermal expansion, a wear ring 100 that is constructed of a high-hardness material, such as ceramic or carbide, or that has one or more high-hardness components, may have a different coefficient of thermal expansion than the adjacent metal of the impeller 102 or diffuser 104. A wear ring 100 may form a close interface with the other side of a running seal 106, and in addition is also in physical contact with its own mounting surface, which is conventionally the metal of the impeller 102 or diffuser 104 to which the wear ring 100 or 108 is fastened. If the wear ring 100 is not protected in some manner from differences in thermal expansion between the wear ring 100 and the metal of the adjacent impeller 102 or diffuser 104, then both the mounting scheme and the other side of the running seal 106 present opportunities for likely breakage.

In the case of driving the high-hardness wear rings 100 when fastened to a rotating part such as the impeller 102, conventional metals have at least some malleability, or have a metallic crystal structure that distributes stress, while a high-hardness wear ring 100 of ceramic or carbide, on the other hand, may be very brittle when subjected to stress applied at a single point on the wear ring 100.

Described below are embodiments for mounting high-hardness wear rings 100 and for driving or powering an ESP pump stage that uses the high-hardness wear rings 100. The two different aspects of protecting the high-hardness wear rings 100 as described above work together in synergy in example ESP stages to protect the high-hardness wear rings 100. The high-hardness wear rings 100 are mounted in a manner that protects them, and the ESP stage is rotationally driven or powered in a manner that protects the high-hardness wear rings 100, in synergy with the protective mounting. Thus, elastic mounting systems and low-stress drive systems work in concert to use and protect the high-hardness wear rings 100 in a multi-stage ESP.

The high-hardness wear rings 100 & 108 may be constructed of one or more materials that are harder and more resistant to wear than metals such as nickel (e.g., Ni-resist) cast iron, conventionally used to make the impeller 102 and diffuser 104 in ESPs. Ceramics and carbides are used herein as representative examples of high-hardness materials for wear rings 100. But the described embodiments for mounting and rotationally driving the wear rings 100 in a manner that protects them can also apply to wear rings 100 made of numerous other hard substances besides ceramics and carbide. For example, the described embodiments for mounting and rotationally driving a high-hardness wear ring 100 may apply to wear rings 100 made entirely of one substance, such as a hard metal, a nonmetal, an alloy, a ceramic, or a carbide, and may also apply to wear rings 100 that have a conventional part combined with and a high-hardness layer or coating that is brittle or that varies in its coefficient of thermal expansion from the material of the remainder of the wear ring 100 or the material of the adjacent impeller 102 or diffuser 104.

Example materials for making a high-hardness wear ring 100 include one or more of silicon carbide (SiC), ceramic $Al_2O_3$, hard forms of carbon (diamond, diamond-like carbon), tungsten carbide, and other materials known for hardness and resistance to wear. In an implementation, a first hard material may be composited with other hard materials, such as carbides, cubic boron nitride (CBN), wurtzite boron nitride (WBN), and so forth. SiC is one of the hardest materials for practical use, has high elastic modulus, and good thermal properties, such as heat conductivity and thermal resistance while undergoing limited thermal expansion. Different variants of diamond-like carbon (DLC) coatings can be applied as a coating to a metal wear ring 100 to make a hardened wear ring 100 with at least a high-hardness wear surface. No conventional metallic materials are known to be comparable to the hardness of SiC ceramics, and no conventional coatings are known to be as hard and effective as DLCs. While very hard, these conventional high-hardness wear materials tend to be brittle during use.

Example Wear Ring Drive Systems

A variety of example drive systems prevent rotation and axial movement of an example high-hardness wear ring 100 relative to the mating stage component while minimizing stress raisers due to notch effects that encourage cracking of a ceramic, carbide, or other high-hardness wear ring 100. A stress raiser (or stress riser) is a location in an object where stress is concentrated. The lifespan of the wear ring 100 is preserved when force is evenly distributed over its area, so a reduction in the distributable area, for example caused by a discontinuous notch, hole, or crack, results in a localized increase in stress in that area.

Figure 2:
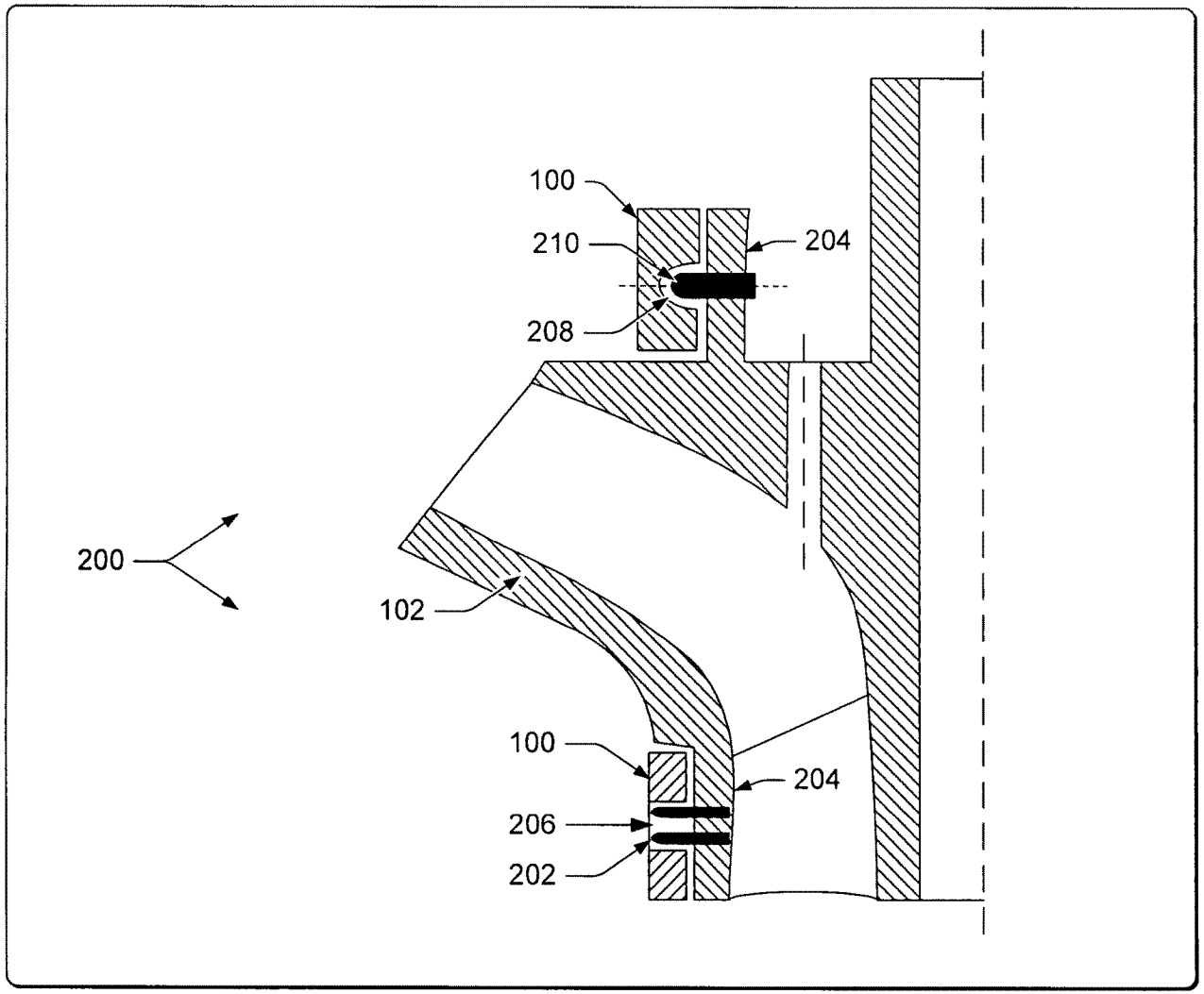
FIG. 2 is a diagram of a first example drive system for protecting high-hardness wear rings in an ESP pump stage.

FIG. 2 shows an example first low-stress drive system 200 for rotationally powering a wear ring 100. The example first drive system 200 uses a radial pin, such as spring pin 202 or a screw fitted in the stage part 204 (part of impeller 102) that engages a through-hole 206 or notch in the wear ring 100. In an implementation, the hole 206 is located approximately in the center of the width of the wear ring 100 to avoid formation of a stress raiser near the edge of the wear ring 100. In an implementation, the hole or notch in the wear ring 100' may be a blind hole 208 (partially through the thickness of the wear ring 100) with a solid pin 210, for example, or a hole all the way through the wear ring 100 (e.g., through-hole 206), depending on the available thickness of the wear ring 100. The edges of the hole 206 or notch and the bottom of a blind hole 208 or notch may be rounded to minimize stress raisers around the hole 206 or 208. The pin may be of a type that absorbs shock, such as a spring "C" pin 202, spiral pin, or roll pin. A shock absorbing element made of rubber, polymer, or a metallic spring, for example, may also be provided to cushion loads or impacts between the wear ring 100, and the outside-diameter surface of the stage part 204 and drive features (e.g., the pin 202 or 210).

Figure 3:
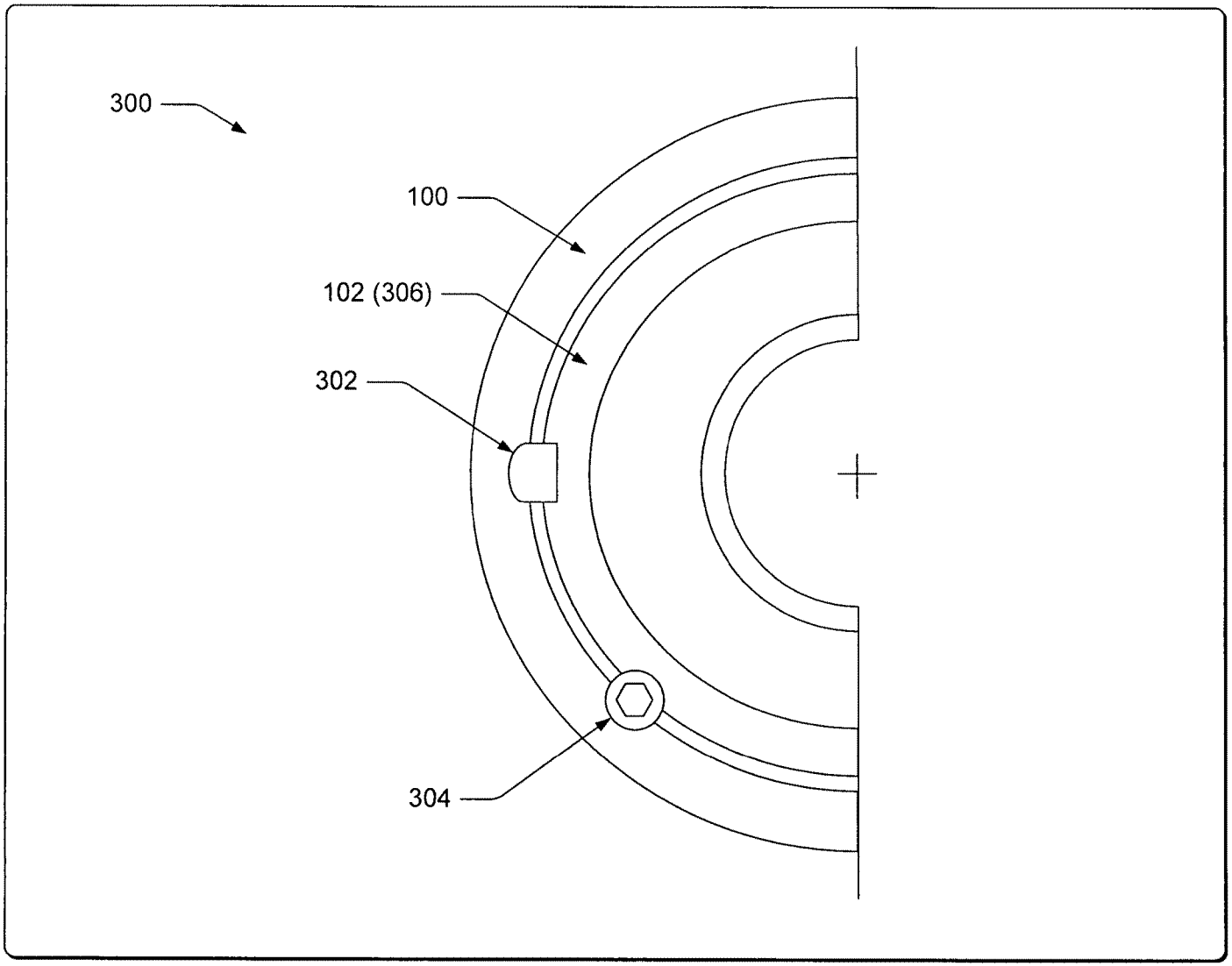
FIG. 3 is a diagram of a second example drive system for protecting high-hardness wear rings in an ESP pump stage.

FIG. 3 shows a second example low-stress drive system 300 that uses an axial key, such as rounded key 302, a pin, or a screw 304 fitted partially in the stage part 306 (e.g., part of impeller 102) and partially in the wear ring 100. The recess in the wear ring 100 is preferably rounded to minimize the stress raiser caused by its presence. Axial movement may be prevented by a retainer, such as a retainer ring, anchored by a variety of means, including an interference fit, a groove, threads, or melting and refreezing metal. A shock absorbing element may also be provided as previously described, between the wear ring 100 and the stage part 306 (102).

Figure 4:
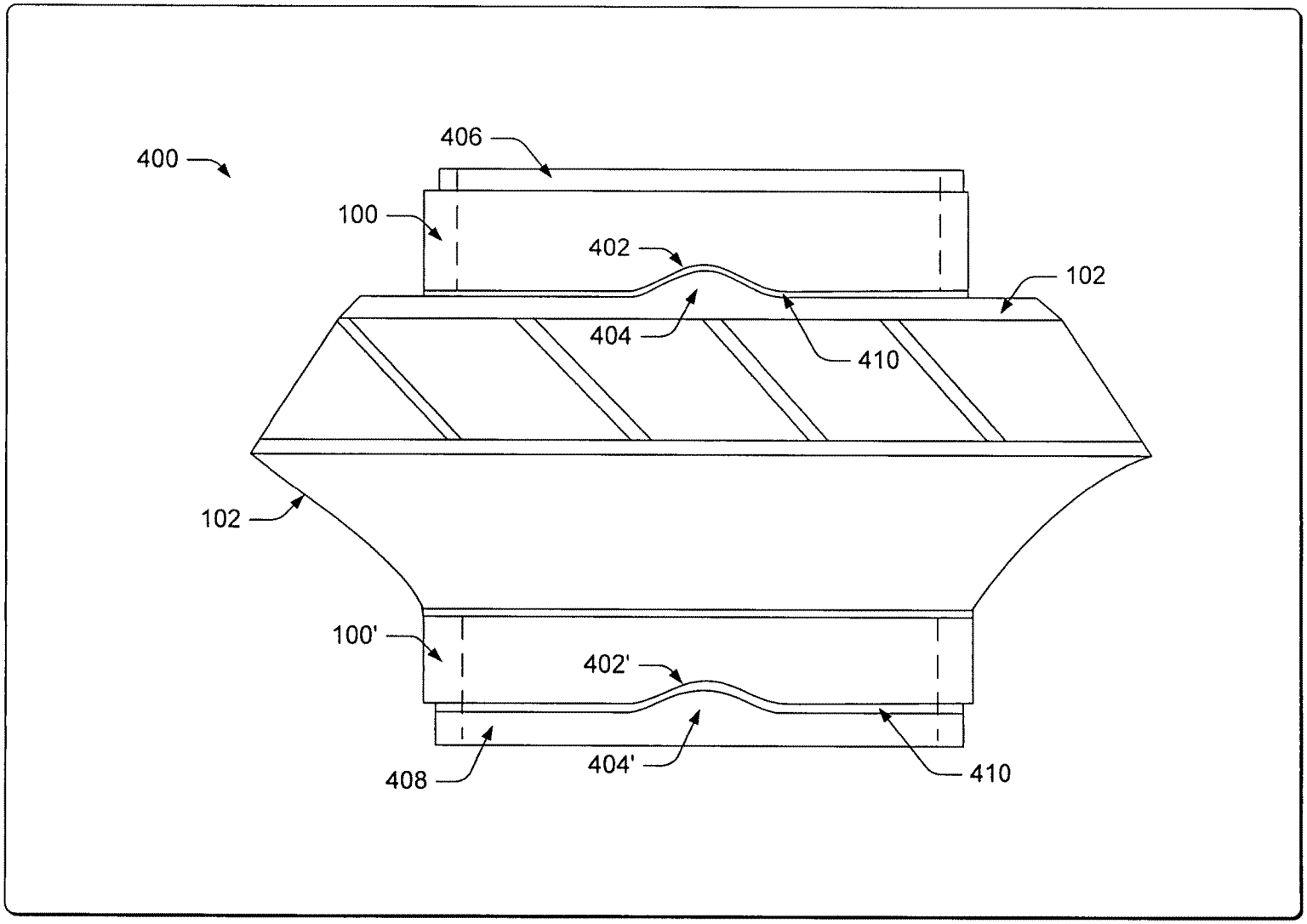
FIG. 4 is a diagram of a third example drive system for protecting high-hardness wear rings in an ESP pump stage.

FIG. 4 shows a third example low-stress drive system 400 that uses an indent or notch 402 (e.g., a rounded notch) on the end or on the edge of an example wear ring 100 for drive. The indent or notch 402 engages a matching lug 404 on the stage part 102. Alternatively (not shown), the lug 404 may be on the wear ring 100 and the notch 402 on the stage part 102. In FIG. 4, the profiles of the notch 402 and the lug 404 are angled and rounded to minimize the stress raiser caused by their presence. The drive lug 404 prevents rotation of the wear ring 100 relative to the stage part 102. Axial movement and disengagement of the lug 404 may be prevented by a retainer ring 406. In a variation, both unwanted axial movement and unwanted rotation are prevented by a combined retainer-and-drive-ring 408 having the drive feature 404' that interfaces with the notch 402' in wear ring 100'. A shock absorbing element 410 may also be provided as previously described. The shock absorbing element 410 may take the form of a flexible ring that conforms to the profile of the drive lug 404 or the form of a wave spring.

Figure 5:
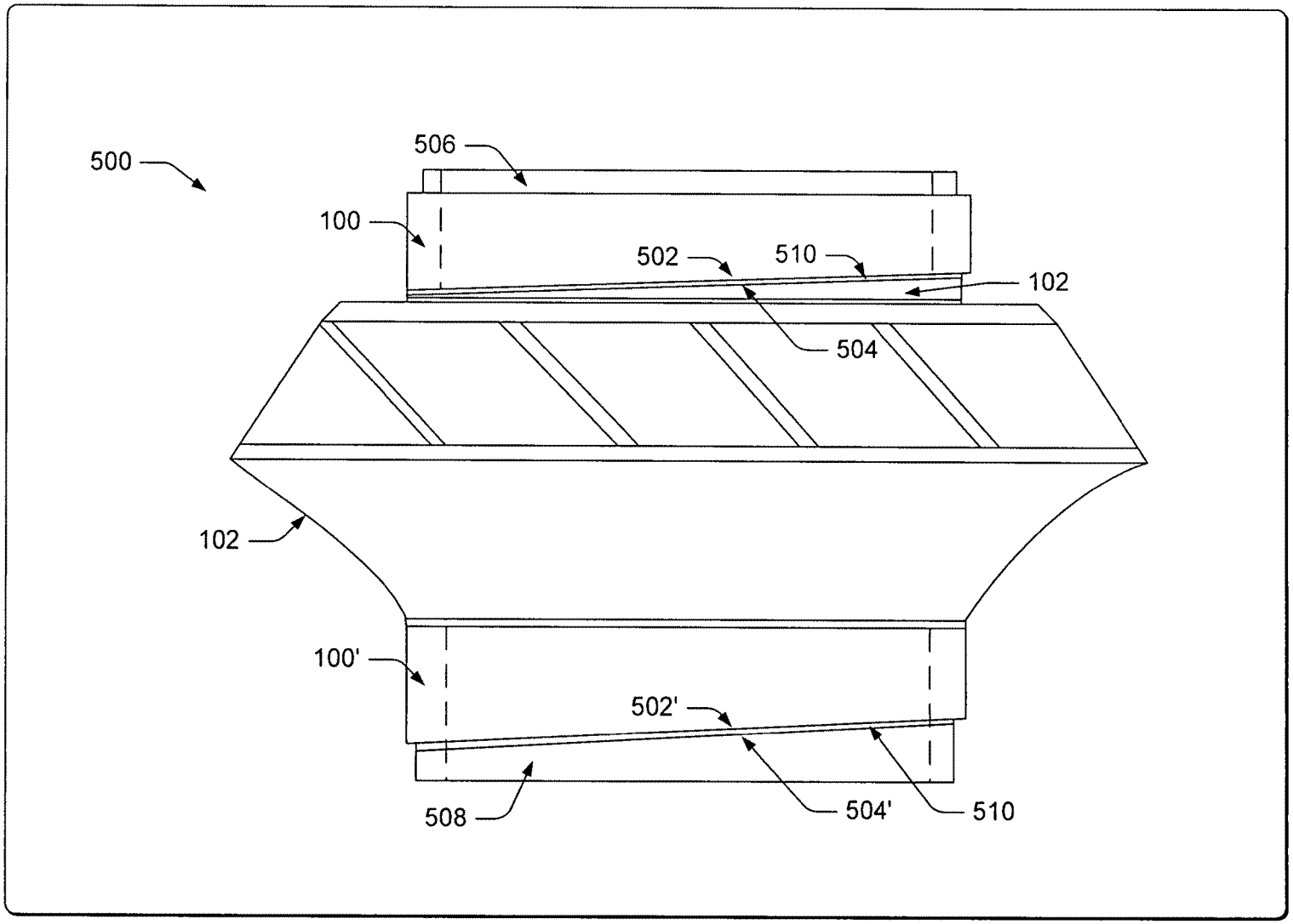
FIG. 5 is a diagram of a fourth example drive system for protecting high-hardness wear rings in an ESP pump stage.

FIG. 5 shows an example fourth lose-stress drive system 500 that uses matching angled end faces 502 & 504 of the wear ring 100 and the stage part 102 to drive the wear ring 100 without causing a stress concentration at a localized part of the wear ring 100. The end faces 502 & 504 are not perpendicular to the axis of the ESP pump stage. Relative rotation tends to drive the angled faces 502 & 504 apart axially. However, axial movement is prevented by a retainer 506, as previously described. In a variation, an angled face, such as angled face 504' and the retainer are combined into an angled retainer ring 508 to prevent both rotational and axial movement of the wear ring 100 relative to the stage part 102. A shock absorbing element 510 may also be provided as previously described.

Example Wear Ring Mounting Systems

Example mounting systems for the high-hardness wear rings 100 both cushion impacts between the wear ring 100 and the mating surface of the stage part (e.g., impeller 102) and accommodate relative thermal expansion and contraction of different adjacent components without exerting undue force on the wear ring 100 or on the other hand, allowing unwanted looseness. In some cases an example mounting system is also sufficiently tight to drive the wear ring 100, eliminating the need for a separate drive system for the wear ring 100.

Example ceramic or carbide high-hardness wear rings 100 have a significantly lower coefficient of thermal expansion than conventional Ni-resist cast iron used in ESP stages. Therefore, the example mounting systems for the high-hardness wear rings 100 may provide for differential thermal expansion and contraction as the temperatures to which the ESP are exposed can be either higher or lower than a standard shop temperature at which the wear rings 100 are fitted to the ESP pump stage.

Specifically, in an implementation, sufficient clearance is desirable between the inside-diameter (ID) surface of a diffuser skirt bore 104 and its mating wear ring 100 at room temperature manufacturing, in order to allow for loss of clearance during thermal changes that can break the wear ring 100 when there is less shrinkage of the wear ring 100 than of the diffuser skirt bore 104 at low temperatures, for example, as encountered in arctic shipment or storage. At these low temperatures, the diffuser skirt bore 104 tightens around the outside of the mating wear ring 100 by thermal shrinkage, and compresses the wear ring 100 until it breaks. When the same diffuser 104 encounters high temperature, e.g., in a steam well, then without one of the example mounting systems, the clearance between the wear ring 100 and the inside-diameter surface of the diffuser skirt bore 104 increases, resulting in unwanted looseness that increases the vibration and wear of the ESP pump stage.

Similarly, sufficient clearance is desirable between the outside-diameter (OD) surface of an impeller skirt 102 and its mating wear ring 108 at room temperature manufacturing to allow for loss of clearance at high temperature due to less expansion of the wear ring than the impeller skirt 102. On the other hand, when the impeller 102 encounters a low temperature operation, for example, in a seabed booster well, without one of the example mounting systems, the OD surface of the impeller skirt 102 contracts, increasing clearance with the mating wear ring 108, resulting in unwanted looseness.

To solve these issues and also in order to cushion impacts and prevent unwanted looseness, an elastic mounting system can be provided between the wear ring 100 or 108 and the mating surface of the stage part 102 or 104.

Figure 6:
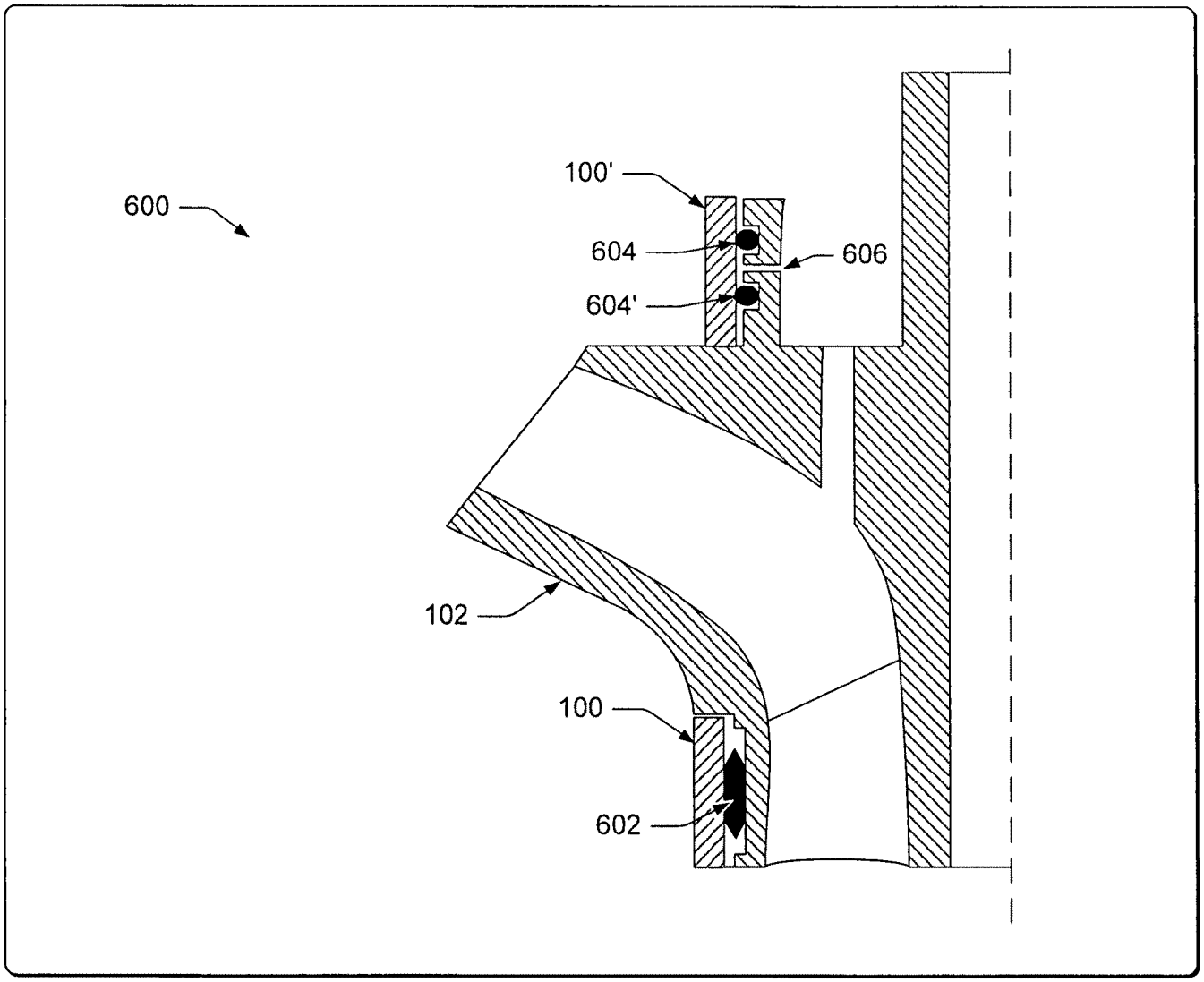
FIG. 6 is a diagram of a first example mounting system for protecting high-hardness wear rings in an ESP pump stage.

An example mounting system may take various forms. As shown in FIG. 6, a first example mounting system 600 comprises one or more elastic ring members, such as a tolerance ring 602 interposed between the mating surfaces of the stage part 102 and the wear ring 100 with sufficient compression to maintain tightness over the range of temperatures. The elastic ring member may be an O-ring 604 between the stage member 102 and the wear ring 100', a spring-loaded polymer lip seal, tolerance ring 602, wave spring, garter coil spring, and so forth. The elastic ring member may be mounted in a groove in either the stage surface 102 or in the wear ring 100 or in both, to stabilize the wear ring 100 position and to limit possible radial displacement of the wear ring 100. To prevent fluid lock between elastic rings members, such as O-rings 604 & 604' that also form a seal between each other, a small equalization hole 606 can be provided in either the stage 102, as shown, or in the wear ring 100'.

Figure 7:
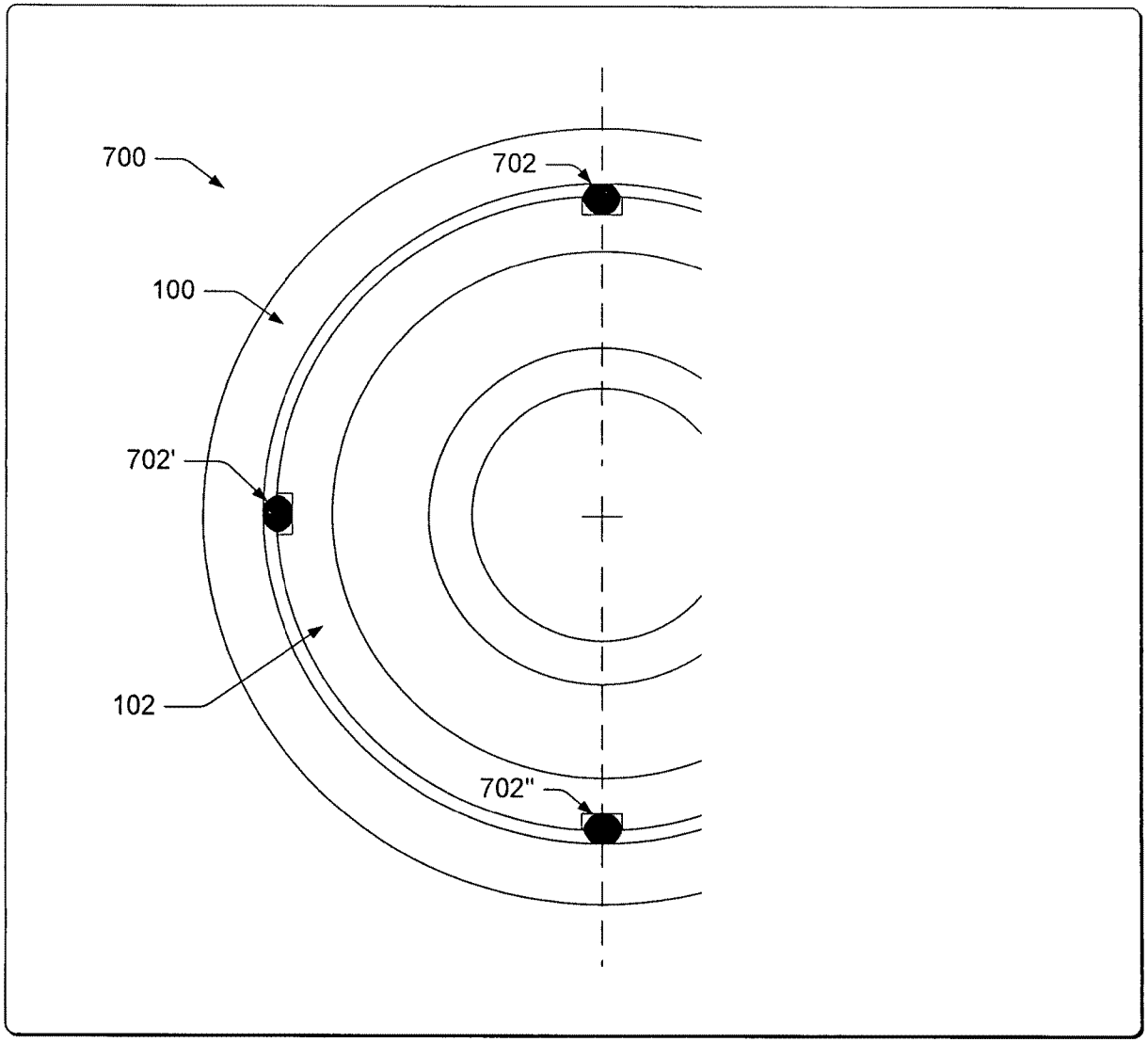
FIG. 7 is a diagram of a second example mounting system for protecting high-hardness wear rings in an ESP pump stage.

FIG. 7 shows a second example mounting system 700 that includes multiple axial elastic elements 702 & 702' & 702" interposed between the mating surfaces of the stage part (e.g., impeller 102) and the wear ring 100 with sufficient compression to maintain tightness over the range of temperatures. The elastic elements 702 & 702' & 702" may be rubber rods, coil springs, leaf springs, and so forth. The elastic elements 702 & 702' & 702" may be mounted in axial grooves in either or both of the stage part 102 or the wear ring 100 to stabilize the positions of the elastic elements 702 & 702' & 702" and limit their radial displacements.

Figure 8:
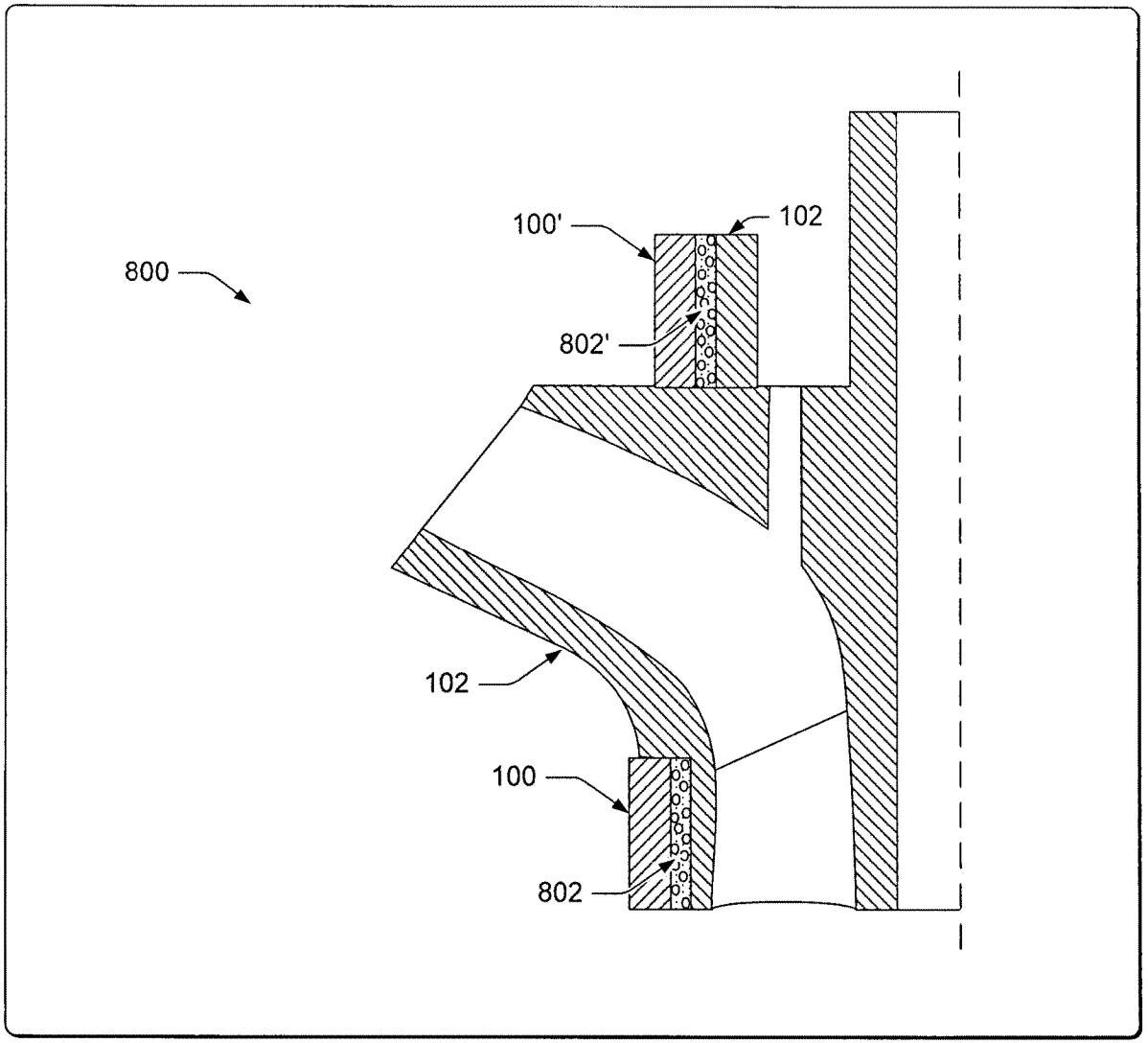
FIG. 8 is a diagram of a third example mounting system for protecting high-hardness wear rings in an ESP pump stage.

FIG. 8 shows a third mounting system 800 that includes a layer of expandable and compressible material 802 & 802' interposed between the stage diameter surface 102 and the wear ring 100. The layer may be a separate thin sheet, a coating that is applied to one of the components, or an adhesive. The layer may be composed of a foam that expands after assembly of the wear ring 100. Expansion of the layer may be accomplished by chemical reaction that releases expanding gas that is trapped inside the material 802 to form the foam. Alternatively, expansion may be accomplished by decompression of a gas that had been previously compressed. Expansion may also be accomplished by previously compressing and "freezing" a foam layer so that it "thaws" and expands after assembly of the wear ring 100. The terms freezing and thawing are used loosely to denote a change in elasticity over time caused by a change in temperature. The layer of expandable and compressible material 802 also functions as a shock absorber to reduce the probability of cracking the wear ring 100. In this function, the layer of expandable and compressible material 802 may also be applied between any of the mating surfaces of the wear ring 100 and other components.

Combination Systems

Example implementations of an ESP pump stage may combine the various example drive and mounting systems described above. The example combinations enumerated below are not meant to limit the possible combinations, but illustrate a variety of practical combinations.

A first example combination combines the first drive system 200 with the first example mounting system 600. A hollow spring pin 202 may be located between two mounting O-rings 604 & 604', for example, so that a bore 206 through the pin 202 also serves as the equalization hole 606 to relieve fluid build-up from between the O-rings 604 & 604'.

A second example combination combines the second drive system 300 with the second mounting system 700. Axial rods 702 & 702' & 702" of strong elastomer may be fitted partially in grooves in the wear ring 100 and partially in grooves in the stage diameter surface 102 to serve as both drive keys 302 and as an elastic and shock-absorbing mounting system 700.

A third example combination combines the third drive system 400 with the third mounting system 800. The expandable foam spacers 802 & 802' in the expandable foam mounting system 800 may also be applied between the drive notches 402 & 402' and drive lugs 404 & 404' to absorb shock.

Example Methods

Figure 9:
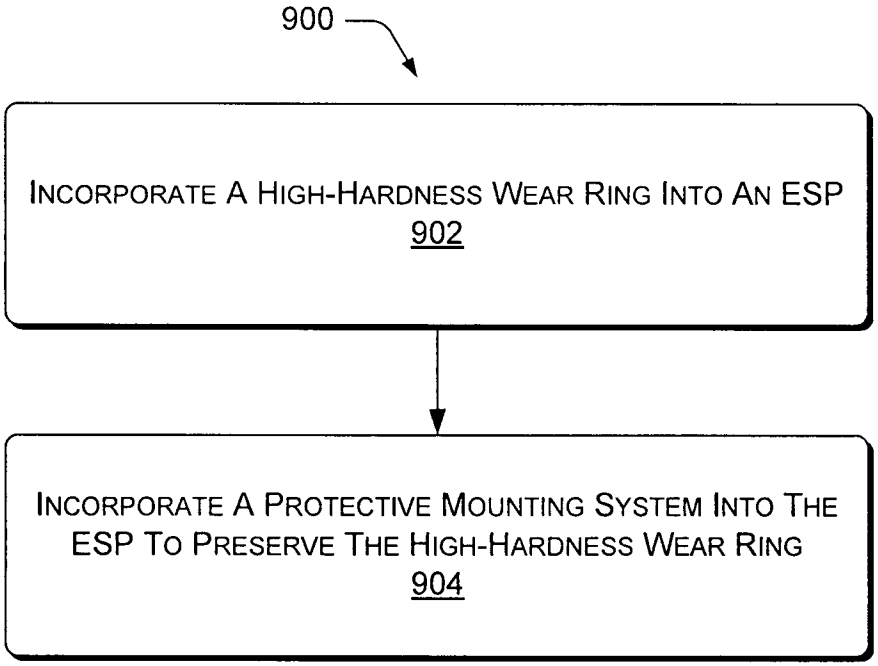
FIG. 9 is a flow diagram of an example method of constructing an ESP pump stage with high-hardness wear rings.

FIG. 9 shows an example method 900 of constructing a wear-resistant ESP pump, for example, a pump stage. In the flow diagram, operations are described in individual blocks.

At block 902, a high-hardness wear ring is incorporated into a pump or at least a pump stage.

At block 904, a protective mounting is incorporated into the pump to protect the high-hardness wear ring, which may be brittle, from breakage and stress. For example, stress and breakage may occur from differences in thermal expansion and contraction between the high-hardness wear ring and nearby mated diffuser or impeller parts. Or the stress and breakage may arise from stress points at members and connectors that attach the wear ring to the pump.

Figure 10:
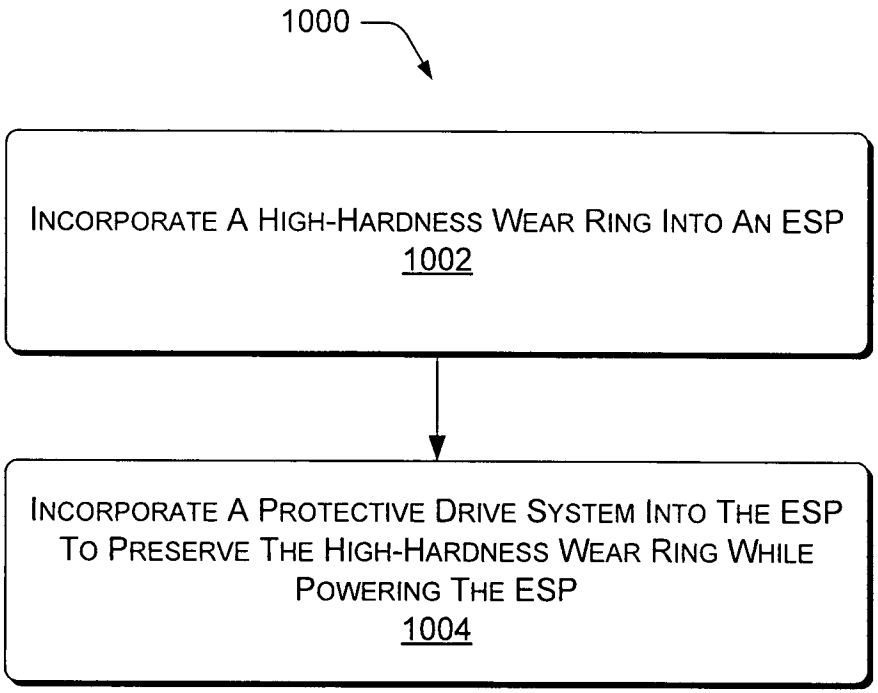
FIG. 10 is a flow diagram of an example method of driving or powering an ESP pump stage that includes high-hardness wear rings needing protection from stress, shock, and thermal expansion and contraction.

FIG. 10 shows an example method 1000 of driving or powering an ESP pump stage that includes high-hardness wear rings that need protection from stress, shock, and thermal expansion and contraction.

At block 1002, a high-hardness wear ring is incorporated into an ESP or at least an ESP pump stage.

At block 1004, a protective drive system is incorporated into the pump to power the impeller in a manner that does not break the high-hardness wear ring. A conventional metal wear ring, on the other hand, is more resistant to stresses and breakage forces because conventional metals are not as brittle as high-hardness materials, such as ceramics or carbides.

CONCLUSION

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

The invention claimed is:

1. A multistage electric submersible pump, comprising:

a plurality of pump stages, at least one pump stage comprising:

an impeller;

a diffuser;

a high-hardness wear ring associated with a running clearance seal between a part of the impeller and a part of the diffuser of the pump stage;

an elastic mounting system for the high-hardness wear ring for minimizing a stress or a breakage of the high-hardness wear ring, wherein the elastic mounting system accommodates a relative thermal expansion and contraction between the high-hardness wear ring and a mating surface of a stage part, and wherein the elastic mounting system is at least partially disposed radially between the high-hardness wear ring and the part of the impeller, wherein the mounting system comprises an elastic member to cushion an impact between the high-hardness wear ring and the mating surface of the stage part, the elastic member comprising two elastic rings, wherein the elastic member maintains a tension between the high-hardness wear ring and the mating surface that limits an expansive force on the high-hardness wear ring while preventing looseness between the high-hardness wear ring and the mating surface; and an equalization hole in the wear ring or in the stage part between the two elastic rings to relieve a pressure between the two elastic rings.

2. The electric submersible pump of claim 1, wherein the high-hardness wear ring comprises one of a ceramic or a carbide.

3. The electric submersible pump of claim 1, wherein the mounting system is sufficiently tight between the high-hardness wear ring and the mating surface to rotationally drive the high-hardness wear ring and eliminate a need for a separate drive mechanism between the high-hardness wear ring and the mating surface.

4. The electric submersible pump of claim 1, wherein at least one of the two elastic rings is mounted in a groove in one of the stage part, the high-hardness wear ring, or in both to stabilize the high-hardness wear ring position and to limit radial displacement of the high-hardness wear ring.

5. The electric submersible pump of claim 1, wherein the mounting system further comprises multiple axial elastic elements interposed between a mating surface of a stage part and the high-hardness wear ring with sufficient compression to maintain tightness over a range of temperatures.

6. The electric submersible pump of claim 5, wherein the axial elastic elements comprise one of rubber rods, coil springs, or leaf springs; and the axial elastic elements are mounted in axial grooves in one of a stage part, the high-hardness wear ring, or both, to stabilize the position of the axial elastic elements and to limit a radial displacement of the axial elastic elements.

7. The electric submersible pump of claim 1, wherein the high-hardness wear ring comprises silicon carbide, ceramic aluminum oxide, diamond-like carbon, tungsten carbide, cubic boron nitride, wurtzite boron nitride, or some combination thereof.

8. A multistage electric submersible pump, comprising:

a plurality of pump stages, at least one pump stage comprising:

an impeller;

a diffuser;

a high-hardness wear ring associated with a running clearance seal between a part of the impeller and a part of the diffuser of the pump stage;

a clearance radially between and immediately adjacent both the high-hardness wear ring and the part of the impeller or the part of the diffuser; and a low-stress drive system for the electric submersible pump for powering the electric submersible pump while preventing a stress or a breakage of the high-hardness wear ring, wherein the low-stress drive system prevents rotational and axial movements of the high-hardness wear ring relative to a mating component while decreasing a stress concentration at one of a notch in the high-hardness wear ring or a hole in the high-hardness wear ring, wherein the drive system includes matching angled end faces of the high-hardness wear ring and a stage part to transmit a driving force from the stage part to the high-hardness wear ring through the matching angled end faces under low stress.

9. The electric submersible pump of claim 8, wherein the low-stress drive system includes a pin or a screw fitted in a stage part that engages a hole or a notch in the high-hardness wear ring.

10. The electric submersible pump of claim 9, wherein a hole located approximately in a center of a width of the high-hardness wear ring avoids formation of a stress raiser near an edge of the high-hardness wear ring.

11. The electric submersible pump of claim 9, further comprising a shock absorbing element between the high-hardness wear ring and the stage part to cushion a load or an impact between the high-hardness wear ring and one of the stage part or a drive feature associated with the stage part.

12. The electric submersible pump of claim 8, further comprising in the low-stress drive system one of an axial key, a pin, or a screw fitted partially in the stage part and partially in the high-hardness wear ring;

a recess in the high-hardness wear ring to receive at least part of the axial key, the pin, or the screw; and wherein the recess is rounded to minimize a stress raiser caused by the recess receiving a driving force.

13. The electric submersible pump of claim 12, further comprising a retainer or a retainer ring to prevent an axial movement of the high-hardness wear ring; and wherein the retainer or the retainer ring is anchored by one of an interference fit, a groove, a thread, or a metal-melting and refreezing process.

14. The electric submersible pump of claim 8, wherein the drive system includes a rounded notch on an end or an edge of the high-hardness wear ring to engage a complementary rounded lug on a stage part providing driving force.

15. The electric submersible pump of claim 8, wherein the high-hardness wear ring comprises silicon carbide, ceramic aluminum oxide, diamond-like carbon, tungsten carbide, cubic boron nitride, wurtzite boron nitride, or some combination thereof.

16. A multistage electric submersible pump, comprising:

a plurality of pump stages, at least one pump stage comprising:

an impeller;

a diffuser;

a high-hardness wear ring disposed radially between a part of the impeller and a part of the diffuser;

a clearance positioned radially between the high-hardness wear ring and the part of the impeller or the part of the diffuser, wherein the clearance accommodates a relative thermal expansion and contraction between the high-hardness wear ring and the part of the impeller or the part of the diffuser;

an elastic mounting system for the high-hardness wear ring for minimizing a stress or a breakage of the high-hardness wear ring, the elastic mounting system comprising two elastic rings, wherein the elastic mounting system is disposed in the clearance; and an equalization hole in the wear ring or in the part of the impeller or the part of the diffuser between the two elastic rings to relieve a pressure between the two elastic rings.

17. The multistage electric submersible pump of claim 16, wherein the clearance and the elastic mounting system are disposed radially between the high-hardness wear ring and the part of the impeller, and the high-hardness wear ring is configured to rotate with the impeller in use.

18. The multistage electric submersible pump of claim 16, further comprising a shaft extending axially through the plurality of pump stages, wherein the part of the impeller is disposed radially between the high-hardness wear ring and the shaft.

* * * * *